US007140278B2

(12) United States Patent
Neumann et al.

(10) Patent No.: US 7,140,278 B2
(45) Date of Patent: Nov. 28, 2006

(54) MANUAL TONGS

(75) Inventors: Rainer Neumann, Herten (DE); Thomas Böker, Bochum (DE); Rolf Nuyken, Herne (DE)

(73) Assignee: Vulkan Lokring GmbH & Co. KG, Herne (DE)

( * ) Notice: Subject to any disclaimer, the term of this patent is extended or adjusted under 35 U.S.C. 154(b) by 197 days.

(21) Appl. No.: 10/473,507

(22) PCT Filed: Feb. 26, 2002

(86) PCT No.: PCT/EP02/02010

§ 371 (c)(1),
(2), (4) Date: Mar. 8, 2004

(87) PCT Pub. No.: WO02/074496

PCT Pub. Date: Sep. 26, 2002

(65) Prior Publication Data

US 2004/0134315 A1 Jul. 15, 2004

(30) Foreign Application Priority Data

Mar. 17, 2001 (DE) ..... 101 13 012

(51) Int. Cl.
*B24B 7/00* (2006.01)

(52) U.S. Cl. ..... 81/427.5; 81/315; 81/316; 81/393; 81/394; 81/345; 81/406; 81/415; 81/427

(58) Field of Classification Search ..... 81/315, 81/316, 393, 394, 395, 406, 415, 427, 427.5
See application file for complete search history.

(56) References Cited

U.S. PATENT DOCUMENTS

| | | | | |
|---|---|---|---|---|
| 109,192 | A * | 11/1870 | Du Bois | 30/145 |
| 2,325,035 | A | 7/1943 | Cargile | |
| 3,596,355 | A * | 8/1971 | Wertepny, Sr. | 30/252 |
| 3,885,309 | A * | 5/1975 | Lund et al. | 30/250 |
| 5,722,171 | A | 3/1998 | Schmidt | |
| 5,974,670 | A | 11/1999 | Hsieh | |
| 6,532,847 | B1 * | 3/2003 | Liou | 81/416 |

FOREIGN PATENT DOCUMENTS

| | | |
|---|---|---|
| DE | 207626 | 3/1909 |
| DE | 3617529 | 11/1987 |

* cited by examiner

*Primary Examiner*—Joseph J. Hail, III
*Assistant Examiner*—Shantese McDonald
(74) *Attorney, Agent, or Firm*—Collard & Roe, P.C.

(57) ABSTRACT

A pair of manual tongs comprising two limbs which are rotatably connected in a common first rotational axis. The first limb is separated into two levers in its lever section, the two levers being rotatably connected in a first articulation, in a second rotational axis parallel to the common first rotational axis. A means of traction connects the second limb to the lever of the first limb, which is situated at a distance from the handle. The means of traction can be shortened by means of a pivotal movement of the lever of the first limb, which is situated close to the handle, above the second rotational axis. The areas of use of the manual tongs are often difficult to access. According to the invention, the second limb of the inventive manual tongs is thus separated into a lever situated at a distance from the handle and a lever situated close to the handle and the two levers are rotatably connected in a second articulation, in a third rotational axis which is parallel to the common first rotational axis.

9 Claims, 8 Drawing Sheets

MANUAL TONGS

CROSS REFERENCE TO RELATED APPLICATIONS

Figure 1:
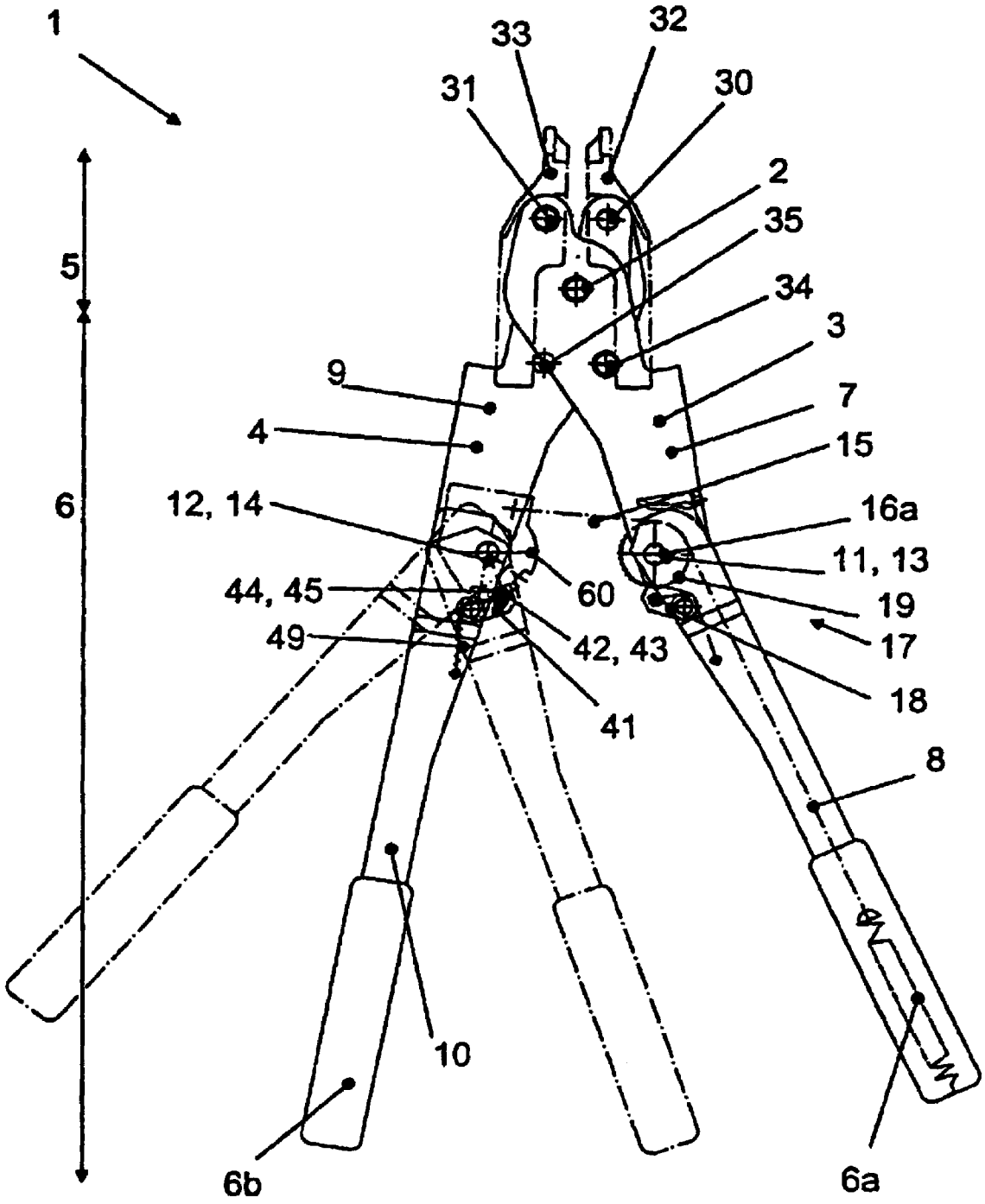

Applicants claim priority under 35 U.S.C. §119 of GERMAN Application No. 101 13 012.0 filed on Mar. 17, 2001. Applicants also claim priority under 35 U.S.C. §365 of PCT/EP02/02010 filed on Feb. 26, 2002. The international application under PCT article 21(2) was not published in English.

A pair of manual tongs comprising two limbs, which are rotatably connected with one another in a common first rotational axis, each of which limbs has a tool segment located on the far side of the common first rotational axis, and a lever segment having a handle, located on the near side of the common first rotational axis, whereby the first limb is separated, in its lever segment, into a lever situated close to the handle and a lever situated at a distance from the handle, these two levers being rotatably connected in a first articulation, in a second rotational axis parallel to the common first rotational axis, where a means of traction connects the second limb to the handle-near end of the lever of the first limb which is situated at a distance from the handle, and said means of traction can be shortened by means of a pivotal movement of the lever of the first limb, which is situated close to the handle, about the second rotational axis.

Such a pair of manual tongs is already known from the German Offenlegungsschrift DE 36 17 529 A1. Just like the pair of manual tongs for assembly purposes described there, the pair of tongs according to the invention is also particularly well suited for the assembly of metal pipe connections using a locking ring. When the locking rings are axially shifted on the ends of the pipes to be connected, extremely high forces have to be generated by means of the tongs. The principle that is already known, that of connecting the two lever segments of the tongs by means of a means of traction, and of building up the desired forces between the tong jaws by way of shortening the means of traction, has proven itself in many years of practice. However, the bulky construction of the tongs, which takes up a lot of space despite the sophisticated mechanics of the tongs, has proven to be a disadvantage. Frequently, the areas of use of the manual tongs, for example pipe ends that must be connected, are in locations that are difficult to access, so that use of a conventional pair of manual tongs requires great dexterity on the part of the assembler, or is actually impossible. In most cases, the assembler is not able to assume a position, during assembly, that allows ergonomically practical operation of the conventional manual tongs. It is not rare that the advantages achieved by the sophisticated lever mechanics are cancelled out in this manner.

Proceeding from the problems of the state of the art, the invention is therefore based on the task of creating a pair of manual tongs that makes it possible, even in a small amount of space and under tight assembly conditions, to generate high forces without additional auxiliary energy.

According to the invention, this task is accomplished by means of a pair of manual tongs of the type described initially, in which the second limb is separated into a lever situated at a distance from the handle and a lever situated close to the handle, and these two levers are rotatably connected in a second articulation in a third rotational axis, which is parallel to the common first rotational axis.

The particular advantage of the innovation according to the invention lies in the great flexibility of handling in tight assembly situations. While it was absolutely necessary for the use of conventional manual tongs to have a generous amount of room available around the intended location of use of the manual tongs, it is now possible to use the manual tongs according to the invention even in spatially tight conditions, in an ergonomically practical manner. In connection with the assembly of pipelines, in particular, the accessibility of the pipe connection location represented a major problem in the past. Even when creating isometric drawings for pipelines, the requirements concerning accessibility for the assembly personnel are an aspect that must be taken into consideration. Since relevant design software does not take such layout aspects into consideration, the need to make pipelines easy to assemble with a conventional tool required significant additional effort until now, resulting in additional costs. In addition, there is the amount of assembly space saved for all of the components to be assembled using a pair of tongs according to the invention.

An advantageous further development of the invention provides that a rotatable profiled latch is affixed to the second articulation, on one of the two levers of the second limb, and that the other lever is provided with a profile that corresponds to the profile of the latch, so that the second articulation can be locked in place in at least one angle position. The lockability of the second articulation by means of a profiled latch has the advantage that the angle position can be varied with minimum effort.

Another possibility of fixing the second articulation of the pair of manual tongs in a certain angle position is presented by bores that align with one another in certain angle positions of the two levers of the second limb, which hold a bolt for the purpose of fixation. Such a reinforcement of the second articulation of the two levers of the second limb is particularly robust and able to withstand great stress. In addition, this variant requires minimum production effort.

Depending on the use of the pair of manual tongs, it can be practical to structure the aforementioned profile of the latch and the profile corresponding to it in rectangular shape, in each instance. For this purpose, it is practical if the latch is provided with only one rectangular projection, and the profile that corresponds to it has several rectangular recesses that match the latter, on the corresponding lever segment. In this manner, the first lever segment can be reinforced in different angle positions relative to the second lever segment, both in the stress direction and in the stress relief direction of the tongs.

Another possibility of reinforcing the second articulation of the lever segment of the second limb is offered by a formation of the latch profile and the profile that corresponds to it in sawtooth form, so that the profile of the latch and the profile that corresponds to it consist of at least one essentially sawtooth-like projection and several essentially sawtooth-like recesses, respectively, whereby the two corresponding sawtooth profiles lock the rotational movement in the stress direction of the pair of manual tongs and release it in the stress relief direction. The advantage of such an embodiment essentially lies in the possibility of being able to change the angle of the second articulation during use of the tongs, in the stress relief direction, and of being able to quickly adapt the ergonomics to the assembly situation in each instance, as needed. The second limb, which acts as a counter-bearing, can thus be brought into the optimal position relative to the first limb, in each instance.

In order for the profiled latch that reinforces the second articulation to always engage in the corresponding profile automatically, it is practical if the latch is biased by means of at least one spring. The spring bias also increases the safety in handling such tongs during consecutive stress and stress relief cycles.

In order for the manual tongs according to the invention not to require any extraordinarily great body strength, it is practical if the lever segment of the two limbs is at least three times as long as the tool segment.

To increase the force between the tong jaws, an advantageous further development of the manual tongs according to the invention provides that the means of traction is guided around a rotatable roller on the second lever segment and attached to the first lever segment. In this manner, the rotatable roller on the second lever segment functions mechanically in the sense of a free deflection roller, and shortening of the means of traction has an effect on the distance between the two levers situated at a distance from the handle, at only half its path length, so that the resulting force between the tong jaws is intensified by a factor of two.

The use of U-profiles in the region of the lever segments of the two limbs of the manual tongs is particularly advantageous in the sense of the strength of the tongs, but also extremely cost-effective.

Figure 2:
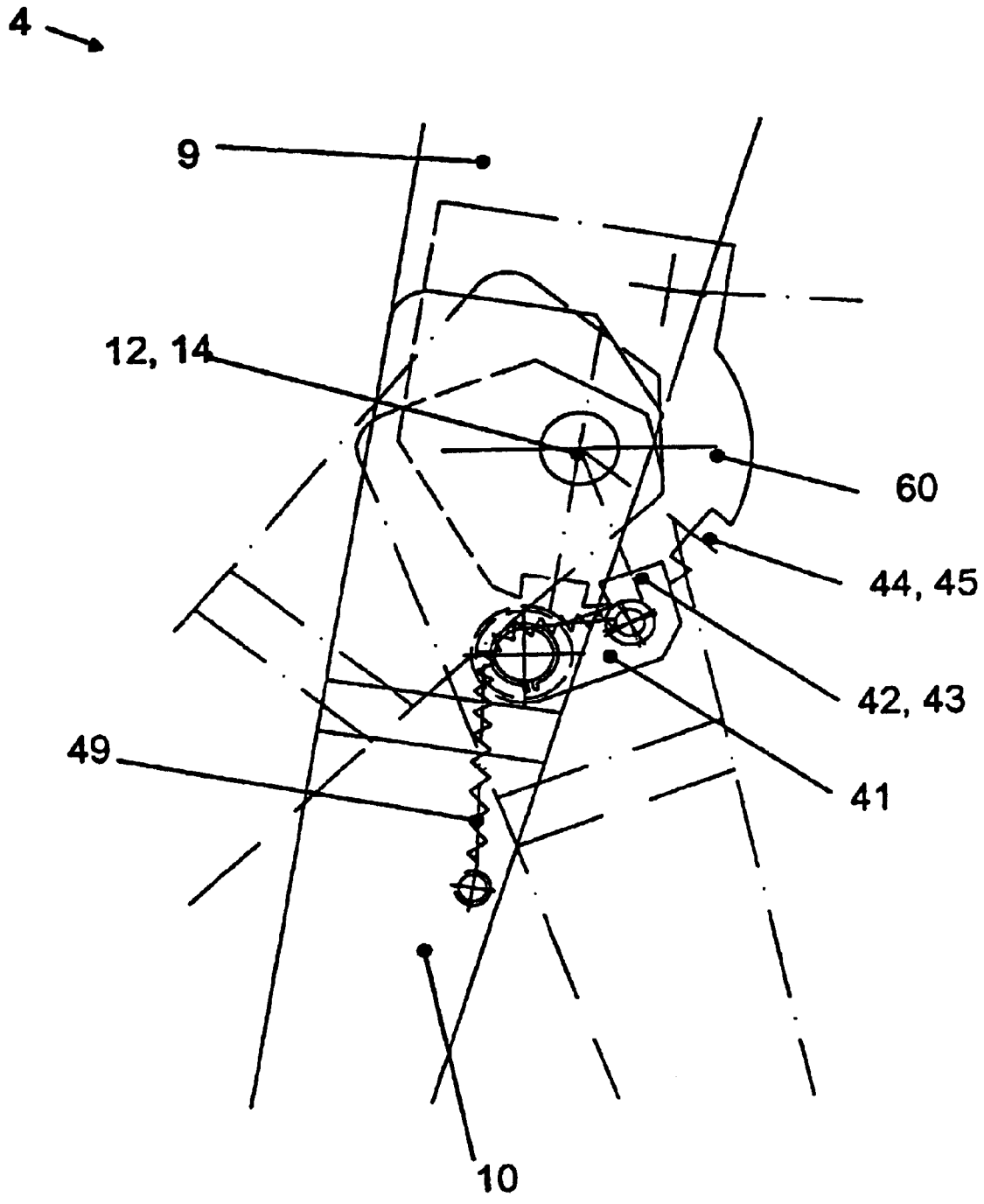
Figure 3:
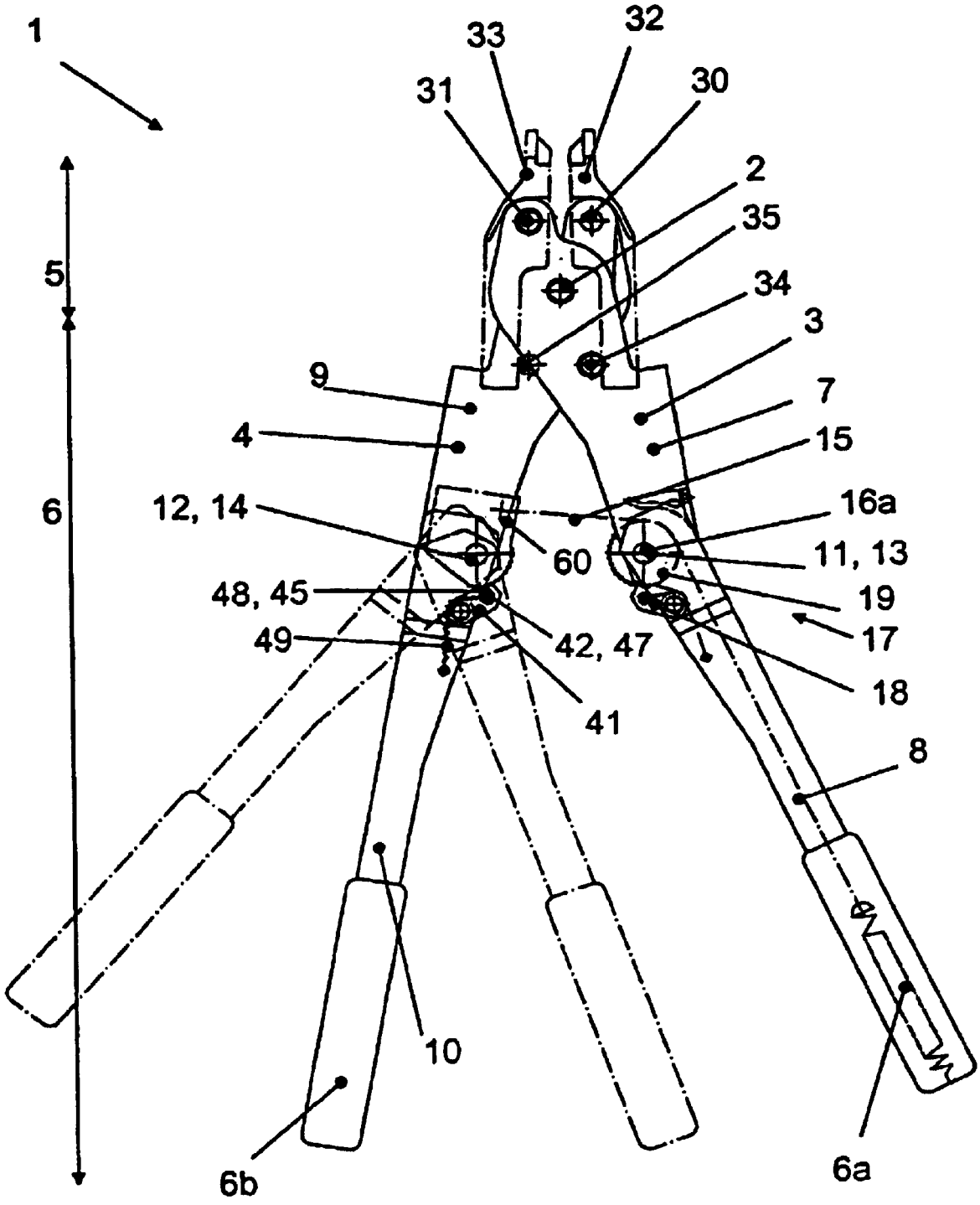
Figure 4:
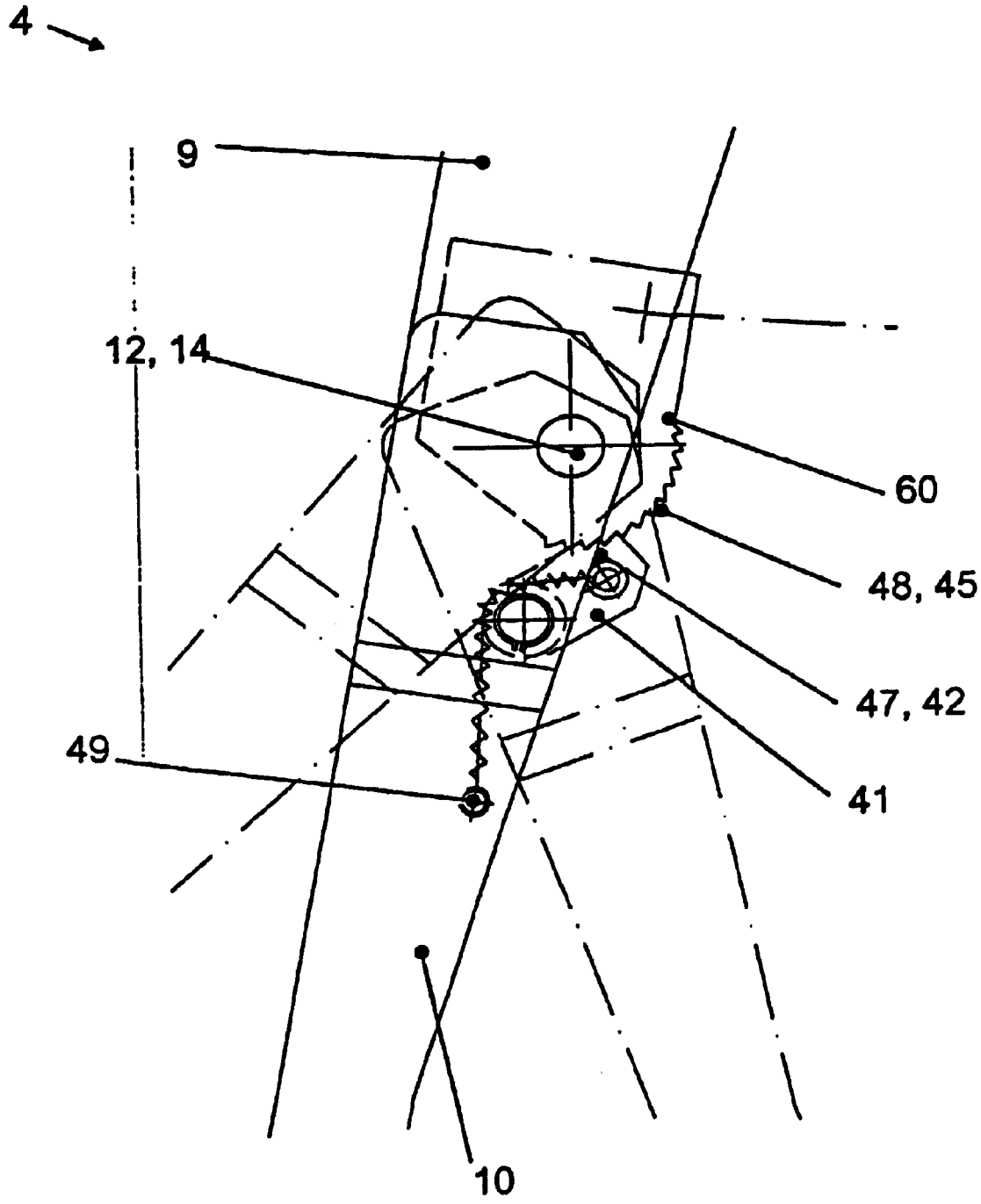
Figure 5:
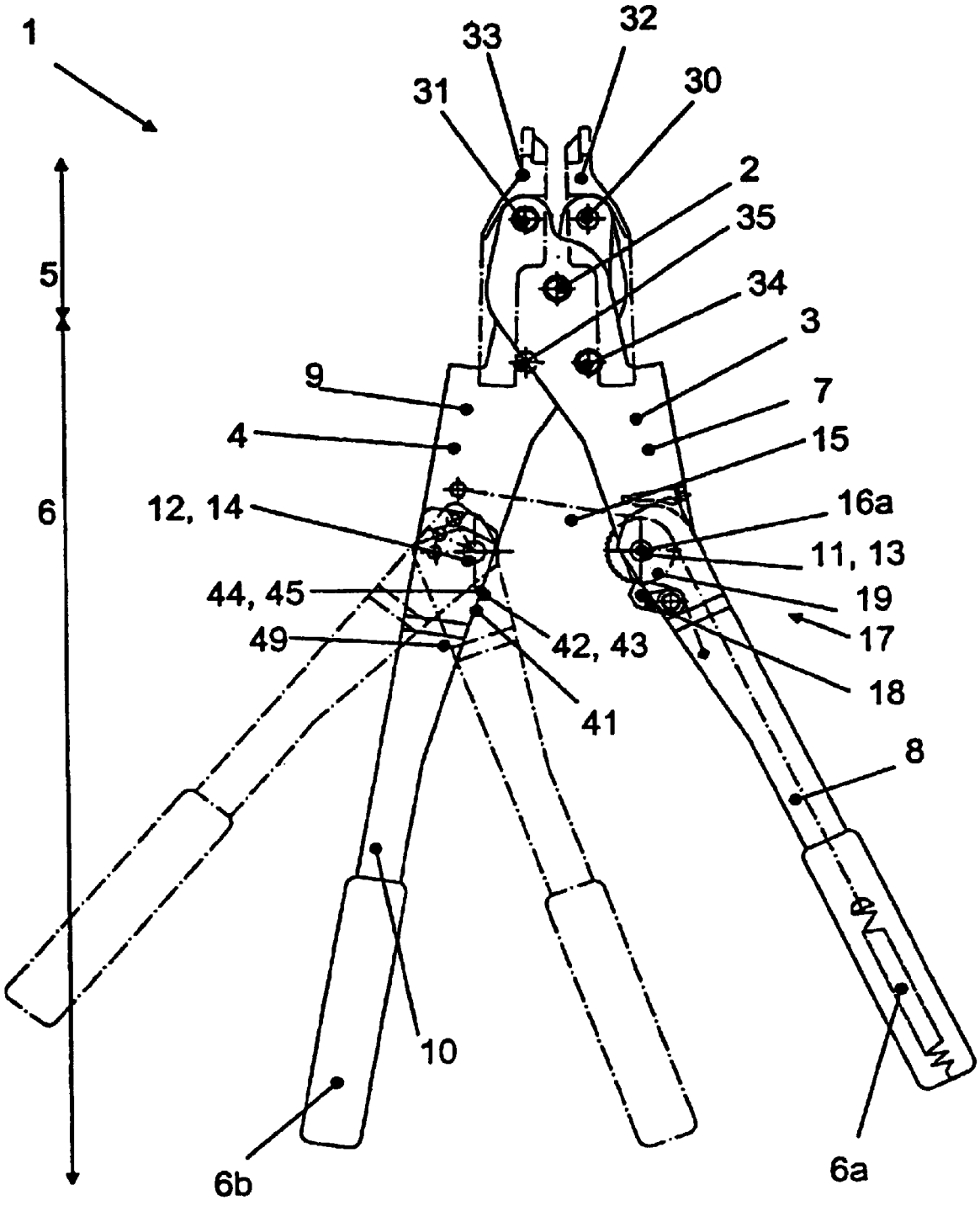
Figure 6:
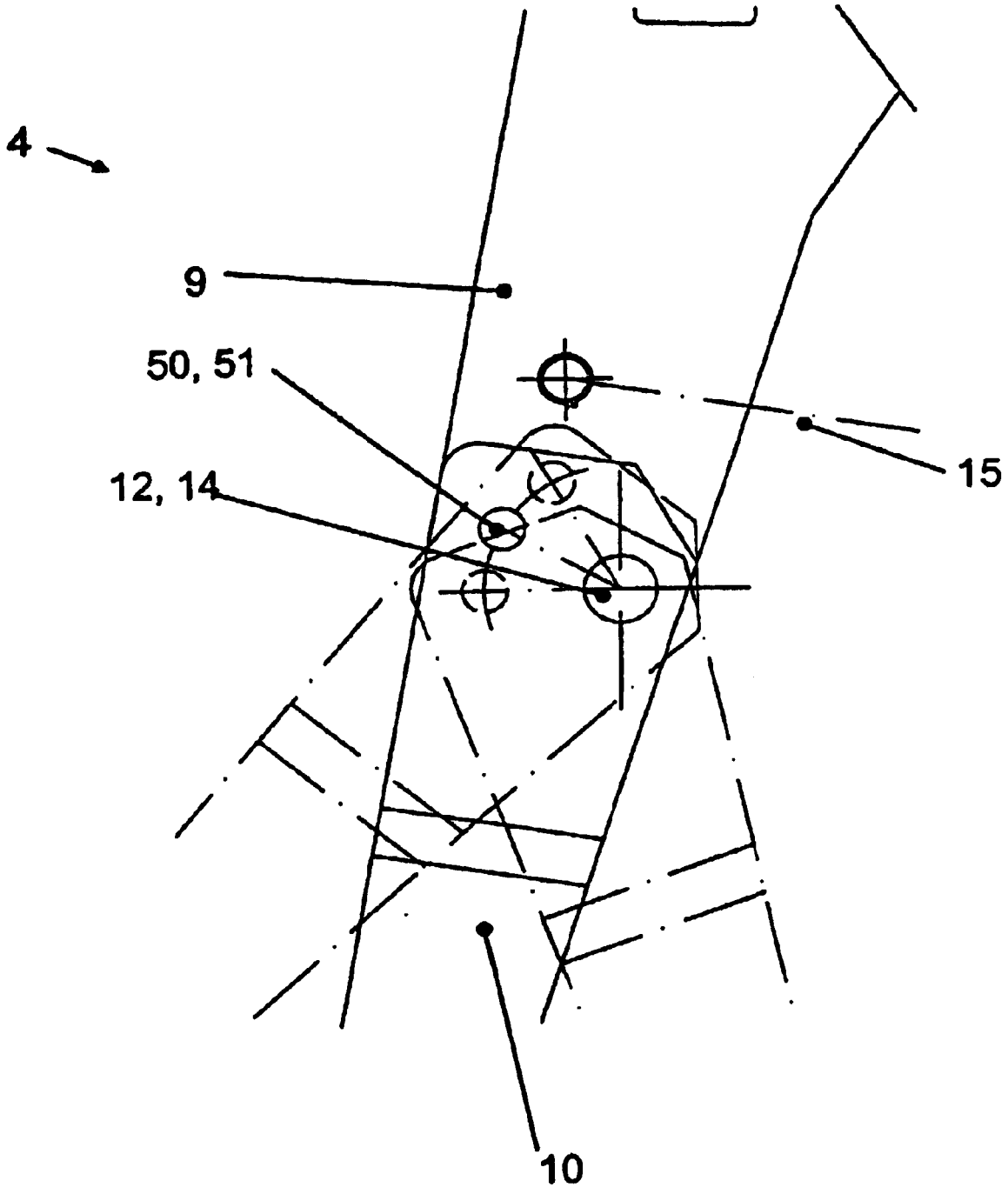
Figure 7:
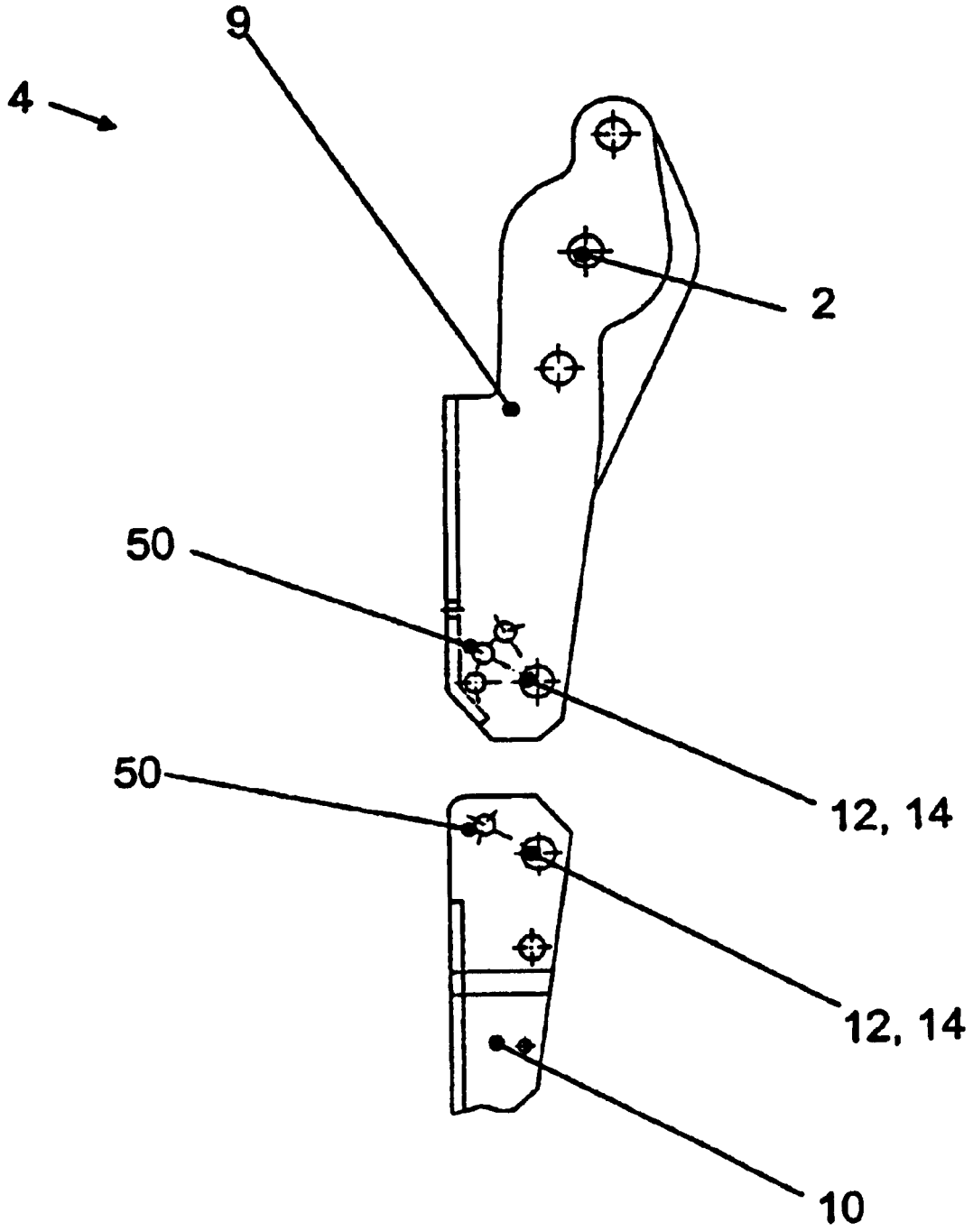
Figure 8:
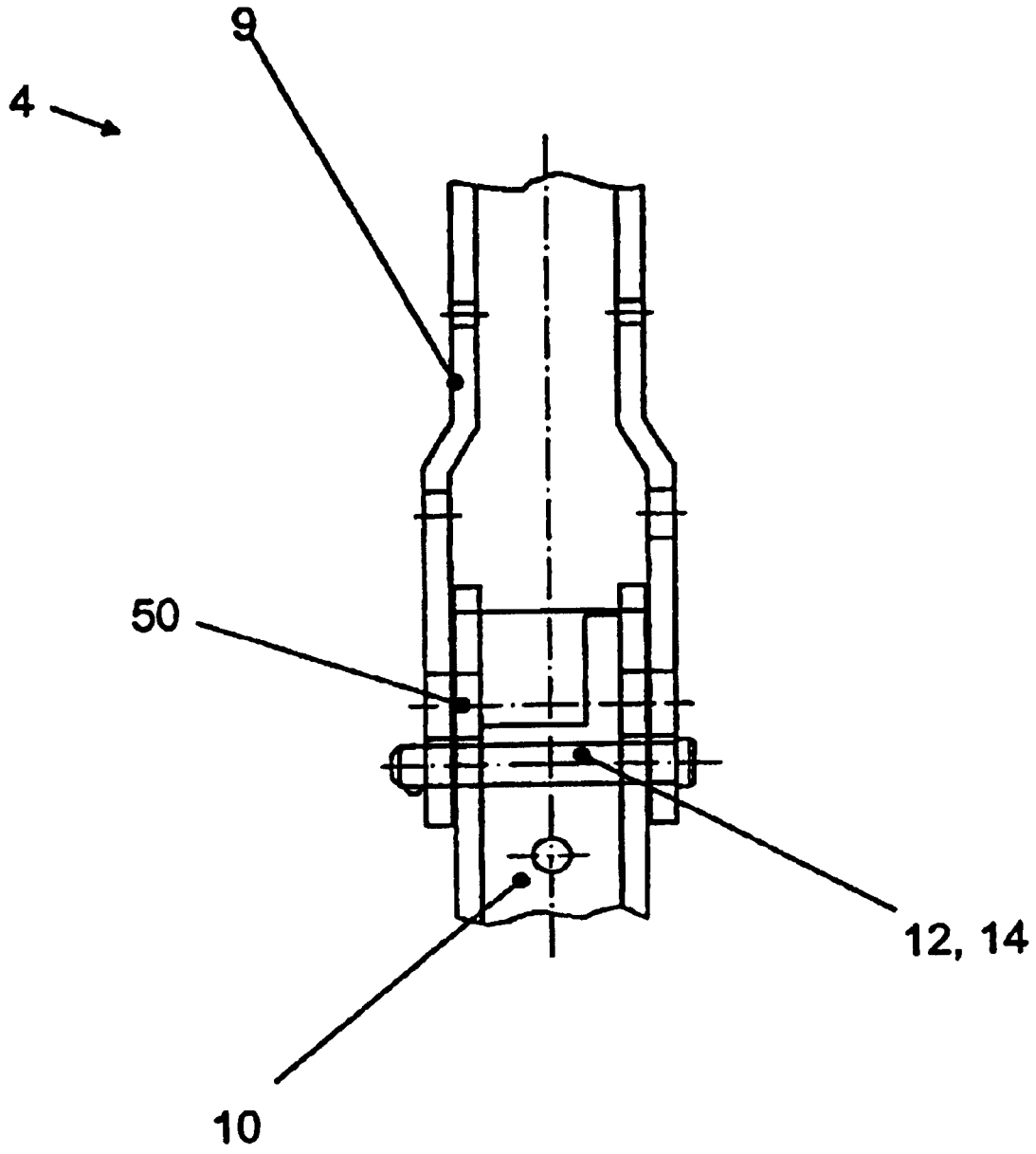

In the following, a specific exemplary embodiment of a pair of manual tongs according to the invention will be described in greater detail, making reference to drawings. These show:

FIG. 1: a top view of a first embodiment of a pair of manual tongs according to the invention, FIG. 2: a partial view according to Detail A shown in FIG. 1, FIG. 3: a top view of a second embodiment of a pair of manual tongs according to the invention, FIG. 4: a detail view according to Detail B shown in FIG. 3, FIG. 5: a top view of a third embodiment of a pair of manual tongs according to the invention, FIG. 6: a detail view according to Detail C shown in FIG. 5, FIG. 7: an individual part drawing of a second limb of a pair of manual tongs according to the invention, according to the third embodiment, up to the second articulation, and a part of the second lever that follows it, and FIG. 8: a top view of the inside of the second articulation of a pair of manual tongs according to the invention, according to the third embodiment.

In all of the representations, the pair of manual tongs 1 is indicated with the reference symbol 1, in its entirety. Its main components are two limbs 3, 4, which are rotatably connected with one another in a first rotational axis 2. The limbs 3, 4 can be separated into a tool segment 5 located on the far side of the first rotational axis 2, and a lever segment 6 located on the near side of the first rotational axis 2. There are handles 6*a*, 6*b* at the ends of the lever segments 6, in each instance. The first limb 3, just like the second limb 4, is separated into a lever 7, 9 situated at a distance from the handle and a lever 8, 10 situated close to the handle. The levers 7, 9 situated at a distance from the handle and the levers 8, 10 situated close to the handle are rotatably another, in each instance, in a first 11 and a second 12 articulation 11, 12, respectively, in a second 13 and a third 14 rotational axis 13, 14, respectively.

In the three different embodiments of the manual tongs 1 according to the invention which are shown as examples, a means of traction 15 extends between the lever segments 6 of the first 3 and the second 4 limb 3, 4. The means of traction 15 is attached to the handle-near end of the lever 9 of the first limb 4 which is situated at a distance from the handle. The means of traction 15, which is structured as a roller chain, is guided over a gear wheel 16, which is connected with a ratchet mechanism 17 on the first articulation 11 by way of a shaft 16*a*, so as to rotate with it, thereby allowing shortening of the means of traction 15 by means of a pivotal movement of the lever 8 of the first limb 3, which is situated close to the handle. The ratchet mechanism 17 consists essentially of a spring-biased latch 18 that automatically prevents a sawtooth-profiled gear wheel 19 from rotating counter to the stress direction.

In the region of the tool segment 5 of the manual tongs 1, the two limbs 3, 4 are each provided with a bolt 30, 31, respectively, to which tong jaws 32, 33 are rotatably attached, in each instance. With point symmetry to the first rotational axis 3, the two limbs 3, 4 each have an additional bolt 34, 35 that corresponds to the bolt 30, 31, respectively, in the region of the lever segments 6, which additional bolt serves as a contact point for the tong jaws 32, 33. Independent of the angle position of the two limbs 3, 4 relative to one another, the tong jaws 32, 33 always move parallel to one another.

The difference between the three different embodiments presented as examples lies in the adjustment and reinforcement possibility of the second articulation 12, which is shown in detail in each instance.

In the first embodiment shown in FIGS. 1 and 2, the second articulation 12 can be locked in place in three different angle positions by means of a profiled latch 41 and a profile 42 that corresponds to it. The projection 43 of the profile 42 of the latch 41 is structured to be rectangular here, so that the second articulation 12 is rigid both in the stress direction and in the stress relief direction. The variant shown shows the arrangement of the rotatable, spring-biased latch 41 on the lever 10 of the second limb 4 that is situated close to the handle and, accordingly, the arrangement of the corresponding profile 45 on the lever 9 of the second limb 4 that is situated at a distance from the handle. A reverse arrangement is also possible. The profile 42 that corresponds to the profile 42 of the profiled latch 41 is introduced into an interchangeable profile element 60 here, which element is rigidly attached to the lever 9 of the second limb 4 that is situated at a distance from the handle.

The second embodiment shown in FIGS. 3 and 4 differs from the first embodiment essentially in the profile 42 of the latch 41 and the corresponding profile 45 at the handle-near end of the lever 9 of the second limb 4 that is situated at a distance from the handle. Here, the latch 41 is provided with a sawtooth-like projection 47, and the corresponding profile 45 has sawtooth-like recesses 48, so that reinforcement of the second articulation 12 takes place only when the pair of manual tongs 1 is under stress, while the second articulation 12 remains rotatable in the stress relief direction.

The third embodiment of a pair of manual tongs 1 according to the invention, shown in FIGS. 5, 6, 7, and 8, shows a particularly robust variant of the angle adjustment in the second articulation 12 of the second limb 4. The handle-remote end of the lever 10 of the second limb 4 that is situated close to the handle, just like the handle-near end of the lever 9 of the second limb 4 that is situated at a distance from the handle, is provided with bores 50 that align with one another, through which a bolt 51 is inserted for the purpose of reinforcing the articulation 12. In this variant as well, the articulation 12 is reinforced both in the stress direction and in the stress relief direction.

The invention claimed is:

1. Pair of manual tongs (1) comprising two limbs (3, 4), which are rotatably connected with one another in a common first rotational axis (2), each of which limbs has a tool segment (5) located on the far side of the common first rotational axis (2), and a lever segment (6) having a handle (6*a*, 6*b*), located on the near side of the common first rotational axis (2), whereby the first limb (3) is separated, in its lever segment (6), into a lever (8) situated close to the handle and a lever (7) situated at a distance from the handle, these two levers (7, 8) being rotatably connected in a first articulation (11), in a second rotational axis (13) parallel to the common first rotational axis (2), where a means of traction (15) connects the second limb (4) to the handle-near end of the lever (7) of the first limb (3), which is situated at a distance from the handle, and said means of traction can be shortened by means of a pivotal movement of the lever (8) of the first limb (3), which is situated close to the handle, about the second rotational axis (13), wherein the second limb (4) is separated into a lever (9) situated at a distance from the handle and a lever (10) situated close to the handle, and these two levers (9, 10) are rotatably connected with one another in a second articulation (12) in a third rotational axis (14), which is parallel to the common first rotational axis (2).

2. Pair of manual tongs (1) according to claim 1, wherein a rotatable profiled latch (41) is affixed to the second articulation (12), on one of the two levers (9, 10) of the second limb (4), and that the other lever (9, 10) is provided with a profile (45) that corresponds to the profile (42) of the latch (41), so that the second articulation (12) can be locked in place in at least one angle position.

3. Pair of manual tongs (1) according to claim 1, wherein the two levers (9, 10) are provided, at the second articulation (12), with bores (50) that align with one another in certain angle positions, thereby allowing fixation by means of a bolt (51) inserted through these bores (50).

4. Pair of manual tongs (1) according to claim 2, wherein the profile (42) of the latch (41) and the corresponding profile (45) consist of an essentially rectangular projection (43) and of essentially rectangular recesses (44), respectively.

5. Pair of manual tongs (1) according to claim 2, wherein the profile (42) of the latch (41) and the corresponding profile (45) consist of at least one essentially sawtooth-like projection (47) and essentially sawtooth-like recesses (48), respectively, whereby the two corresponding sawtooth profiles (47, 48) lock the rotational movement in the stress direction of the pair of manual tongs (1) and release it in the stress relief direction.

6. Pair of manual tongs (1) according to claim 4, wherein the latch (41) is biased by means of at least one spring (49), in such a way that the corresponding profiles engage in one another automatically.

7. Pair of manual tongs (1) according to claim 1, wherein the lever segment (6) is at least three times as long as the tool segment (5).

8. Pair of manual tongs (1) according to claim 1, wherein the means of traction (6) is guided around a rotatable roller on the second lever segment and attached to the first lever segment.

9. Pair of manual tongs (1) according to claim 1, wherein the limbs (3, 4) are structured as a U-profile, at least in segments, in the region of the lever segment (6).

* * * * *